United States Patent [19]

Berger

[11] Patent Number: 5,025,931

[45] Date of Patent: Jun. 25, 1991

[54] MODULAR DISPLAY SYSTEM

[75] Inventor: Barry D. Berger, New York, N.Y.

[73] Assignee: R. N. Koch, Inc., Providence, R.I.

[21] Appl. No.: 600,494

[22] Filed: Oct. 19, 1990

[51] Int. Cl.[5] ..... A47F 5/00

[52] U.S. Cl. ..... 211/13; 211/189; 248/176

[58] Field of Search ..... 211/189, 13, 87; 248/176, 902

[56] References Cited

U.S. PATENT DOCUMENTS

| | | | |
|---|---|---|---|
| 2,546,811 | 3/1951 | Anderson | 211/189 X |
| 4,157,760 | 6/1979 | Wilson | 211/13 |
| 4,614,272 | 9/1986 | Shelton et al. | 211/13 X |
| 4,718,561 | 1/1988 | Eckert | 211/13 |
| 4,838,505 | 6/1989 | Lowe | 248/176 |

*Primary Examiner*—Robert W. Gibson, Jr.

*Attorney, Agent, or Firm*—Salter & Michaelson

[57] ABSTRACT

Modular system for constructing racks for the display of merchandise, the system consisting of a vertically-elongated convex element of semi-cylindrical cross-section joined to a vertically-elongated concave element of rectilinear U-shaped cross-section.

11 Claims, 3 Drawing Sheets

MODULAR DISPLAY SYSTEM

BACKGROUND OF THE INVENTION

In the retail sale of merchandise, such as sunglasses, it is common practice to provide free-standing racks or pillars on which the merchandise is displayed. These racks stand either on a counter or on the floor of the retail establishment. They are provided with clips or the like to hold a large and varied number of the items to be sold, the clips being usually located in the vicinity of eye level.

Because of the variation in display locations and the number of items to be sold, it is difficult to design and construct a single rack that will serve all purposes. The tendency, then, is to construct a custom-made rack for each situation. This is not only expensive, but discourages re-arrangement or reconstruction of the rack to satisfy changed conditions at the merchandising site. These and other difficulties experienced with the prior art devices have been obviated in a novel manner by the present invention.

It is, therefore, a primary object of the present invention to provide a display system making use of modular elements capable of being arranged in a variety of ways.

Another object of this invention is the provision of a system for constructing many different kinds of merchandise display racks from a limited number of basic modular elements.

A further object of the instant invention is the provision of a merchandise display rack which is simple and from readily-available materials, and which is capable of a long life of useful service with a minimum of maintenance.

It is another object of the instant invention to provide a display rack, particularly for the retail sale of sunglasses and the like, whose nature enhances the appearance of the merchandise and permits a customer to examine the displayed items without handling them.

A still further object of the invention is the provision of a modular display system which permits the alternate arrangement of lightweight concave and convex elements to produce an exceptionally strong structure.

It is a further object of the invention to provide a display system consisting of injection molded elements that are easily fastened together in a large variety of ways.

Another object is the provision of a display rack, particularly for the retail sale of sunglasses and the like, wherein certain portions of the rack display the glasses with their temple bars or bows in extended position, whereas other portions of the rack display the glasses in folded orientation.

With these and objects in view, as will be apparent to those skilled in the art, the invention resides in the combination of parts set forth in the specification and covered by the claims appended hereto.

SUMMARY OF THE INVENTION

In general, the invention has to do with a modular display system using a vertically-elongated convex element with a semi-cylindrical cross-section and a vertically-elongated concave element with a rectilinear recess. The two elements are joined along vertical portions to form a sinuous structure. Attachment means for supporting merchandise is located in the centermost portion of the convex element and the innermost portion of the concave element.

Preferably, the merchandise to be supported consists of a plurality of sunglasses; the attachment means on the convex element consists of vertically-spaced hooks, while the attachment means on the concave element consists of a plurality of vertically-spaced trays. The convex element and the concave element are joined by bridges located on the same levels as are the hooks. The outer surface of the convex element is formed with a regular pattern of horizontal corrugations. The recess surface of the concave element is defined by a main wall from the vertical edges of which extend vertical divider walls; the surface of the main wall is slightly bowed and is provided with a regular pattern of horizontal corrugations.

DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
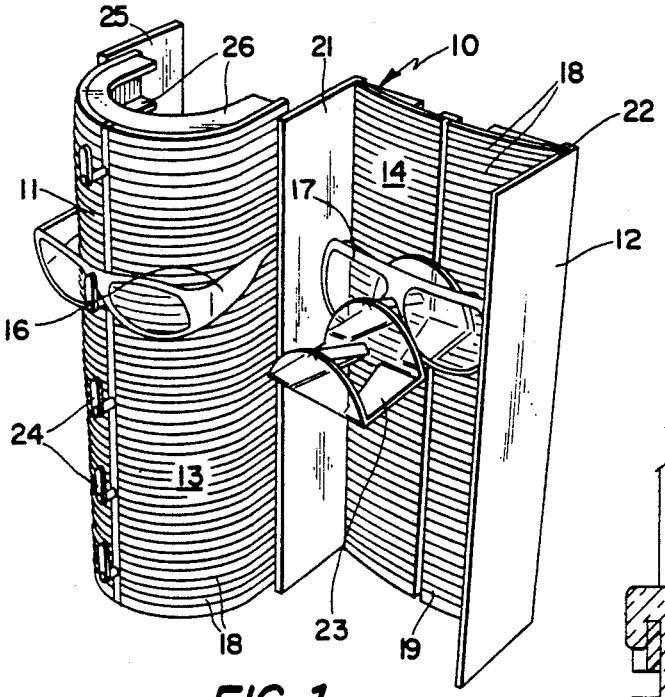
FIG. 1 is a perspective view of a modular display system incorporating the principles of the present invention.

Referring first to FIG. 1, wherein are best shown the general features of the invention, the modular display system, indicated generally by the reference numeral 10, is shown as made up of a vertically-elongated convex element 11 and a vertically-elongated concave element 12. The convex element 11 has a generally semi-cylindrical, forwardly-directed outer surface 13. The concave element 12 has a generally rectilinear, forwardly-directed recess surface 14. The elements 11 and 12 are joined along adjacent vertical sides by vertically-spaced bridges 15. Means is provided for supporting merchandise, such as sunglasses 16 and 17 (see FIG. 1), on the outermost portion of the surface 13 of the convex element 11 and the innermost portion of the recess surface 14 of the concave element 12, respectively.

In the preferred embodiment of the invention, the convex element and the concave element are formed of a strong, light polymer by injection molding. The outer surface 13 of the convex element 11 is formed with a regular pattern of horizontal corrugations 18 and a main portion of the recess surface 14 of the concave element 12 is similarly formed with horizontal corrugations. The nature of the corrugations 18 is particularly well shown in FIG. 4.

Figure 2:
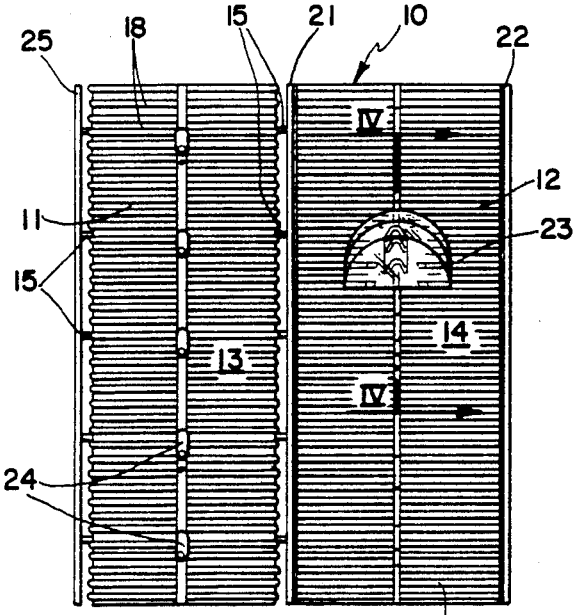
FIG. 2 is a front elevational view of the display system.

The aforementioned recess surface 14 of the concave element 12 is defined by a vertical main wall 19 of generally rectangular shape with opposite parallel edges to which are attached vertical divider walls 21 and 22. The main wall 19 is provided with slightly bowed forward surface which is provided with the previously-described corrugations 18. The support means associated with the convex element 11 to hold the sunglasses 16 consists of a plurality of hooks 24 which may extend integrally from an elongated vertically disposed support strip or which may comprise a plurality of individual hook elements. The supporting means associated with the concave element 12 for holding the merchandise, such as sunglasses 17, consists of a plurality of vertically-spaced trays 23. As is evident in FIG. 2, each of the bridges 15, which join the convex element 11 to the concave element 12 is located at approximately the same level as corresponding clip 24, so that a pair of sunglasses 16 can be supported with its nosepiece on a clip 24 and its bow members resting on aligned bridges.

Figure 3:
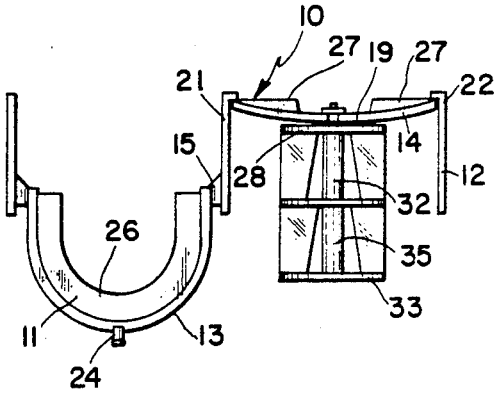
FIG. 3 is a plan view of the invention.

In a preferred form of the invention, a divider wall 25, which is similar to the divider walls 21 and 22, is connected by bridges to the side of the convex element opposite the side to which the divider wall 21 is connected. The rearwardly-directed surface of the convex element is provided with several horizontal reinforcing flanges 26 located at vertically-spaced intervals. As is evident in FIG. 3, each of these flanges is generally horseshoe-shaped. Similarly, reinforcing flanges 27 are formed on the rear surface of the main wall 19 of the concave element 12.

Figure 4:
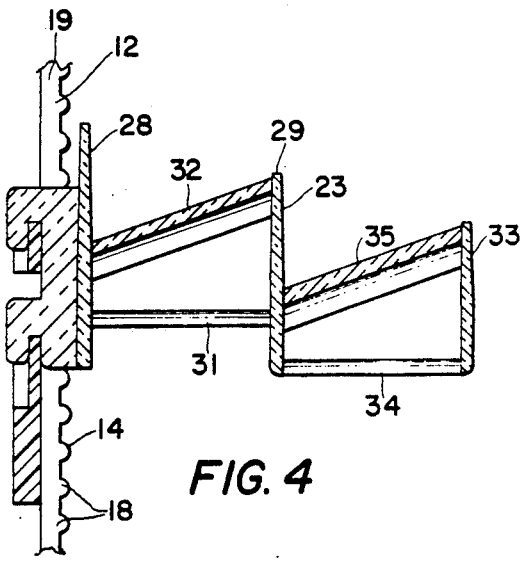
FIG. 4 is a somewhat enlarged, vertical sectional view of the invention, taken on the line IV—IV of FIG. 2.

FIG. 4 illustrates the construction of the display tray 23 and the manner in which it is mounted in the main wall 19 of the concave element 12. The tray is similar to the display tray that is shown and described in my patent application Ser. No. 07/600,495 which was filed on Oct. 19, 1990. As such, it uses a hook-and-slot method of mounting on the wall 19. It consists of two vertical walls 28 and 29 joined by a floor 31 and by an inclined support post 32. A third vertical wall 33 is located in parallel, spaced relationship to the wall 29 and is joined to it by a floor 34 and an inclined support post 35. The assemblage or unit formed by the wall 29, the floor 34, and the support post 35 resides at a lower level than the assemblage formed by the wall 28, the floor 31, and the support post 32. In this way, a pair of sunglasses 17 carried on the support post 32 will be located above a pair that is carried on the support post 35 and will not be hidden by it. As will be obvious the sunglasses displayed on tray 23 are in folded disposition, whereas the sunglasses mounted on convex element 11 are displayed with their bow members rearwardly extended, thus permitting a prospective purchaser to get some idea as to what the sunglasses look like when worn, it being noted that the configuration of convex element 11 generally simulates the shape of a person's skull. Preferably, the location of hooks 24 corresponds horizontally with the mounting locations for trays 23, whereby the same style sunglasses may be displayed side by side in both folded and extending positions, and in varying colors.

The operation and advantages of the present invention will now be readily understood in light of the above description. The display system 10, formed by the convex element 11 and the concave element 12, constitutes a unit which has, in the plan view, a sinuous or S-shaped configuration. By itself, it is very strong, but it is nevertheless light in weight, despite its strength. Therefore, it makes an excellent rack for displaying merchandise, such as a varied selection of sunglasses, this being true when it is used by itself or when it is combined with other similar units. In order to obtain a unit of greater height, it is only necessary to stack two or more of the units vertically. To obtain a rack that faces in several direction, the units can be combined in side-by-side relationship and fastened together. A large selection of racks can, therefore, by constructed not only by vertical stacking and by forming a side-by-side cluster, but also by combining the two arrangements. For instance, a counter rack can be obtained by stacking a relatively few clusters. On the other hand, a tall, floor-mounted rack can be produced by stacking a relatively large number of clusters.

Figure 5:
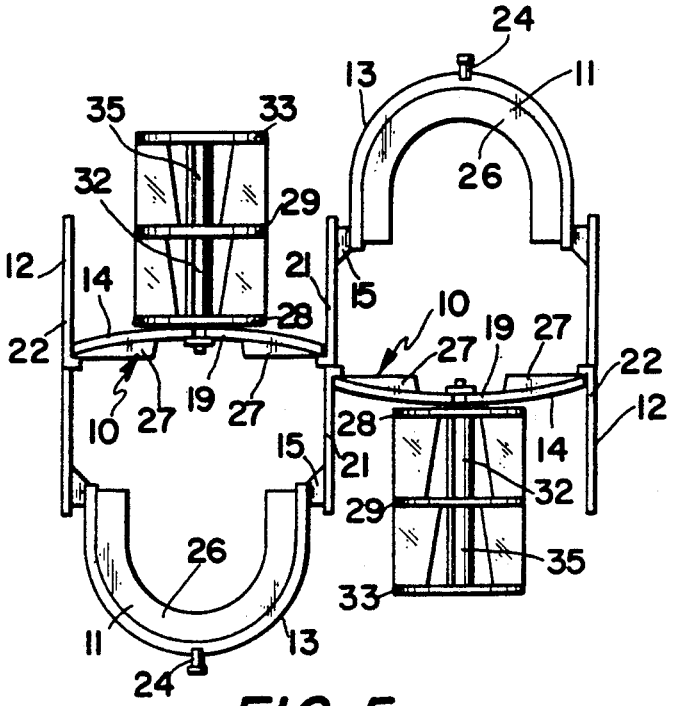
FIG. 5 is a schematic plan view of a cluster comprising back-to-back modular units.
Figure 6:
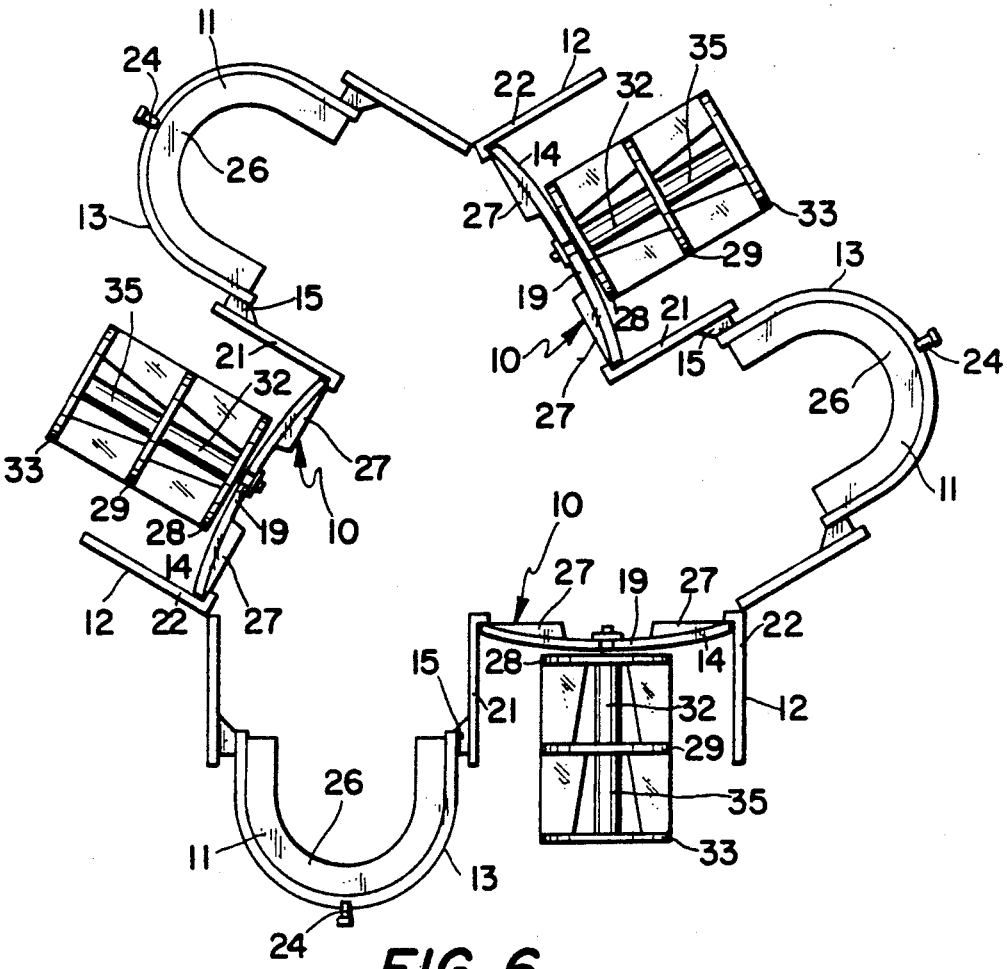
FIG. 6 is a schematic plan view of a cluster of three modular units in triangular relation.
Figure 7:
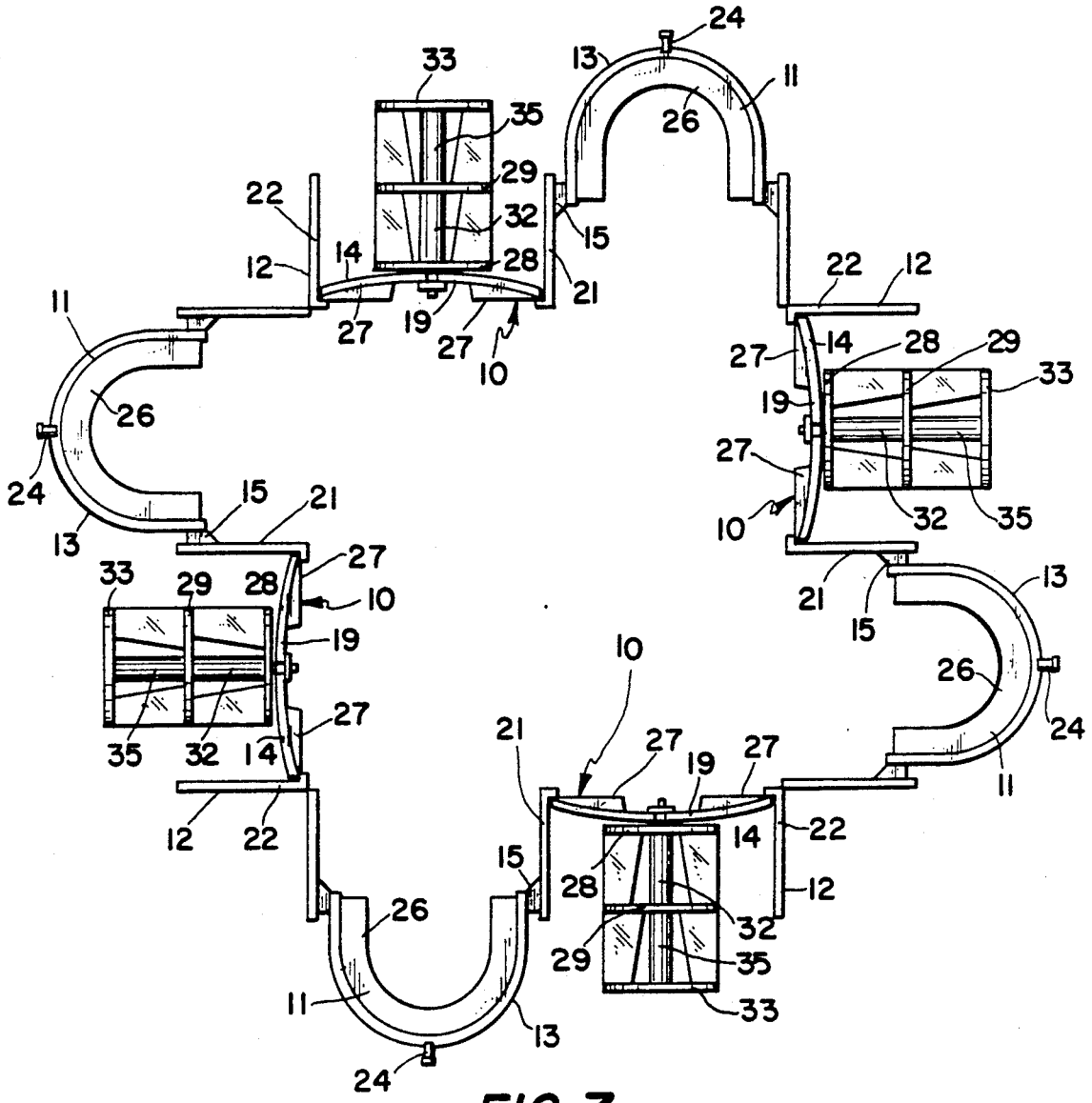
FIG. 7 is a schematic plan view of a cluster of four modular units forming a square.

A cluster can be made by fastening two units in back-to-back relationship, as illustrated in FIG. 5, three units can be combined to form a triangular configuration, as illustrated in FIG. 6, and four units to form a square configuration, as illustrated in FIG. 7. The number and arrangement of units is only limited by one's imagination. The use of the cluster arrangement not only provides a great deal of display surface, but also results in considerable strength, particularly in the vertical direction. The column resulting from vertical stacking of similar clusters forms an attractive rack that takes up very little floor space and is particularly useful when mounted on a base for rotation about a vertical axis passing through the geometric center of rotation of the clusters.

In addition to providing for physical strength and a large amount of display area for a given amount of floor space occupied by the rack, the configuration of the individual units contributes to a pleasant appearance.

Because the units are all the same, it is possible to provide for the manufacture of a wide variety of racks to be used in a retail merchandising establishment on demand. This does away with expensive custom-made units and the attendant storage problems. It is only necessary for the manufacturer to maintain a supply of individual units in his inventory, while offering the retailer fast delivery of a wide selection of rack types and sizes.

It is obvious that minor changes may be made in the form and construction of the invention without departing from the material spirit thereof. It is not, however, desired to confine the invention to the exact form herein shown an described, but it is desired to include all such as properly come within the scope claimed.

The invention having been thus described, what is claimed as new and desired to secure by Letters Patent is:

1. Modular display system, comprising (a) a vertically-elongated convex element having a generally semi-cylindrical outer surface, (b) a vertically-elongated concave element having a rectangular recess surface joined to the convex element along one side, and (c) means for supporting merchandise, which means is associated with the outermost portion of the surface of the convex element and with the innermost portion of the concave element.

2. Modular display system as recited in claim 1, wherein the convex element and the concave element are formed of a polymer by injection molding.

3. Modular display system as recited in claim I, wherein the outer surface of the convex element is formed with a regular pattern of horizontal corrugations.

4. Modular display system as recited in claim 1, wherein the recess surface of the concave element is defined by a vertical main wall having vertical divider walls extending at right angles to its vertical edges.

5. Modular display system as recited in claim 4, wherein the main wall is provided with a slightly-bowed outer surface that is formed with a regular pattern of horizontal corrugations.

6. Modular display system as recited in claim 1, wherein the merchandise to be supported consists of a plurality of sunglasses, wherein the supporting means on the convex element is a plurality of vertically-spaced hooks, and wherein the supporting means on the concave element is a plurality of display trays extending horizontally forwardly of the innermost portion of the recess surface.

7. Modular display system as recited in claim 6, wherein the convex element and the concave element are joined by integral bridges located on the same levels as the hooks.

8. Display rack formed from a plurality of similar modules, each module comprising (a) a vertically-elongated convex element having a generally semi-cylindrical forward surface, (b) a first vertical divider wall extending rearwardly from one rear edge of the convex element, (c) a second vertical divider wall extending rearwardly from the other rear edge of the convex element, the vertical divider walls being spaced and parallel, (d) a third vertical divider wall which is spaced from and parallel to the second vertical divider wall, and (e) a forwardly-bowed main wall joining the rear vertical edges of the second and third divider walls to form a concave element therewith.

9. Display rack as recited in claim 8, wherein the first and second divider walls are joined to the rear edges of the convex element by a plurality of vertically-spaced bridges.

10. Display rack as recited in claim 9, wherein the forward surface of the convex element is provided with merchandise hooks, each hook being on a level with a bridge associated with the first and second divider walls.

11. Display module, comprising a vertically-elongated convex element having a generally semi-cylindrical surface and a vertical divider wall extending rearwardly from each rear edge of the convex element, wherein the divider walls are joined to the rear edges of the convex element by a plurality of vertically-spaced bridges.

* * * * *